US011202932B2

(12) United States Patent
Poeta, IV

(10) Patent No.: US 11,202,932 B2
(45) Date of Patent: Dec. 21, 2021

(54) FREE WEIGHT RING AND METHOD OF MAKING SAME

(71) Applicant: AFIT Patent Co., Newark, DE (US)

(72) Inventor: Rockey Poeta, IV, Newark, DE (US)

(73) Assignee: AFIT Patent Co.

( * ) Notice: Subject to any disclaimer, the term of this patent is extended or adjusted under 35 U.S.C. 154(b) by 22 days.

(21) Appl. No.: 16/730,229

(22) Filed: Dec. 30, 2019

(65) Prior Publication Data

US 2020/0206557 A1 Jul. 2, 2020

Related U.S. Application Data

(60) Provisional application No. 62/786,114, filed on Dec. 28, 2018.

(51) Int. Cl.
*A63B 21/06* (2006.01)

(52) U.S. Cl.
CPC ..... *A63B 21/0603* (2013.01)

(58) Field of Classification Search
CPC . A63B 21/0603; A63B 21/06; A63B 21/4035; A63B 41/085; A63B 41/10; A63B 21/075; A63B 21/0726; A47G 2400/083
See application file for complete search history.

(56) References Cited

U.S. PATENT DOCUMENTS

| | | | | |
|---|---|---|---|---|
| 4,602,784 | A * | 7/1986 | Budden | A63B 21/065 482/105 |
| 8,622,877 | B2 | 1/2014 | Raines et al. | |
| 10,105,566 | B2 * | 10/2018 | Buikema | A63B 21/075 |
| 2009/0205106 | A1 * | 8/2009 | Sohn | A61F 5/0118 2/170 |
| 2019/0184252 | A1 * | 6/2019 | Raines | A63B 21/072 |

* cited by examiner

*Primary Examiner* — Nyca T Nguyen
*Assistant Examiner* — Andrew M Kobylarz
(74) *Attorney, Agent, or Firm* — The Belles Group, P.C.

(57) ABSTRACT

A free weight includes: an enclosure comprising a plurality of body sections assembled in a shape approximating a torus, each body section forming part of the approximated torus and having a sectional seam formed along an approximated major diameter of the approximated torus, and each body section is coupled to each adjacent body section at an inter-sectional seam, each inter-sectional seam formed along an approximated section diameter of the approximated torus; and a fill disposed within an interior space formed by the enclosure.

19 Claims, 15 Drawing Sheets

FREE WEIGHT RING AND METHOD OF MAKING SAME

CROSS-REFERENCE TO RELATED APPLICATIONS

Priority is claimed to U.S. Provisional Application No. 62/786,114, filed Dec. 28, 2018, the disclosure of which is incorporated herein by reference in its entirety.

FIELD OF THE INVENTION

The field of the present invention relates to free weights for use as strength training and rehabilitation equipment and methods for making such free weights.

BACKGROUND

Weights are commonly used as part of strength training and rehabilitation routines. Some of the more common weights are referred to as free weights, which are weights that are not connected to an external apparatus. Free weights include items such as barbells, dumbbells, kettlebells, medicine balls, and sandbags. Each of these types of free weights has advantages for certain types of strength exercises. Of these, the barbells, dumbbells, kettlebells, and hard rubber medicine balls can cause injury if accidentally dropped on any part of the body. Also, several of these free weights can be difficult to grip for people who are undergoing rehabilitation and have not yet developed physically sufficient. Grip problems can result from the size and shape of the free weight, the weight of the free weight, and/or the material from with the free weight is made from, as some material is slippery, especially when tossed, and can become more slippery with perspiration during exercises, resulting in grip difficulties.

Even sandbags may result in grip problems when equipped with an actual handle or formed in a shape that provides a location for a secure handhold. In some sandbag designs, the handles can actually be irritating to the hands of the user. The good thing with sandbags is that when they are dropped, they are very unlikely to cause injury due to an impact from dropping than those free weights constructed from hard materials such as metals, plastics, or hard rubber. One of the downsides with many types of sandbags that are available on the market is that they tend to leak sand, and sand in the exercise room may cause a risk of slip and falls and respiratory irritation. Another downside is that many sandbags tend to include shifting voids due to sand moving around inside them, and these shifting voids, even in those sandbags which include handles, can make them hard to grip. Even soft medicine balls are naturally bulky and require two hands to hold. In addition, the roundness and the material used for soft medicine balls tends to make them slippery and somewhat difficult to use during exercises.

Some free weights are filled with a composite material such as black rubber, also known as "crumb rubber," which are synthesized copolymers of styrene, butadiene, benzene, and polycyclic aromatic hydrocarbons, and such chemicals are known to have toxic effects through contact and vapor. In addition, some types of free weights are coated with vinyl chloride, which is another chemical known to give off harmful vapors.

A free weight is therefore desirable which has the advantages of sandbags which significantly reduce the risk of injury when dropped and which reduces and/or eliminates problems associated with gripping the free weight. Such a free weight should also be versatile so that it is useable for a wide range of strength exercises and rehabilitation exercises.

SUMMARY OF THE INVENTION

The present invention is directed toward a free weight ring. The free weight ring is made from a plurality of sections coupled together to approximate a torus or an elliptical torus. Each of the sections are coupled together so as to minimize void spaces, significantly reduce and or eliminate leakage of a granular fill, and to facilitate gripping of the free weight ring.

In a first separate aspect of the present invention, a free weight includes: an enclosure comprising a plurality of body sections assembled in a shape approximating a torus, each body section forming part of the approximated torus and having a sectional seam formed along an approximated major diameter of the approximated torus, and each body section is coupled to each adjacent body section at an inter-sectional seam, each inter-sectional seam formed along an approximated section diameter of the approximated torus; and a fill disposed within an interior space formed by the enclosure.

In a second separate aspect of the present invention, a method of making a free weight includes: coupling a plurality of body section patterns together, each body section pattern comprising a first long edge, a second long edge, a first short edge, and a second short edge, the first long edge of each body section pattern coupled to the second long edge of another body section pattern; coupling the first short edge to the second short edge of each body section pattern so that each body section pattern forms a hollow cylinder section, the combined hollow cylinder sections forming an enclosure in a shape approximating a torus, the short edges of the body section patterns forming a sectional seam along an approximated major diameter of the approximated torus, wherein a gap is left in the short edges of at least one of the body section patterns for insertion of a fill into an interior space formed by the enclosure; filling the interior space with the fill; and sealing the gap.

Accordingly, an improved free weight ring and method of making the same are disclosed. Advantages of the improvements will be apparent from the drawings and the description herein.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION OF THE INVENTION

Figure 1:
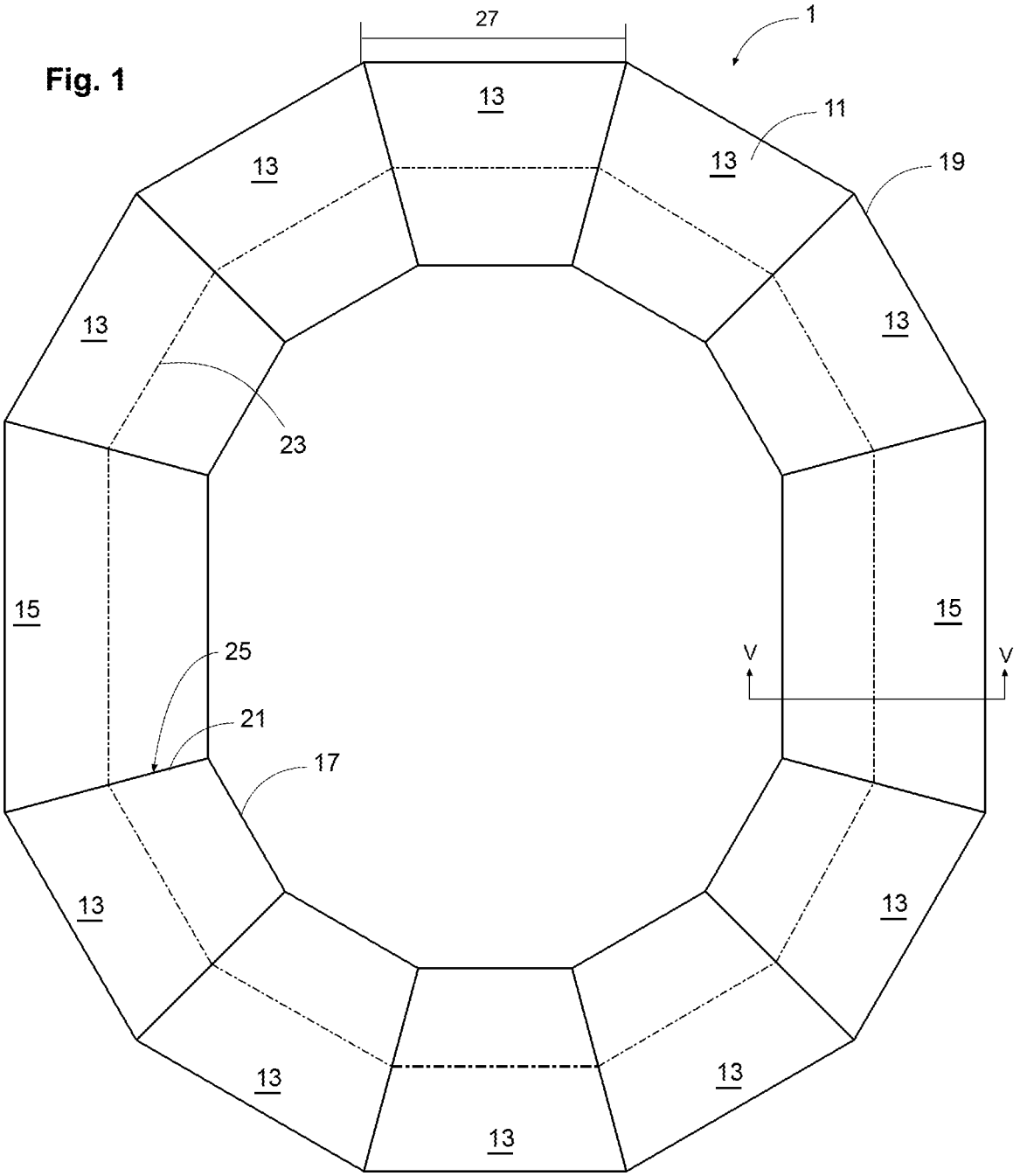
FIG. 1 shows a top planar view of a free weight ring in accordance with a first embodiment.

Turning in detail to the drawings, FIG. 1 illustrates a free weight ring 1 in accordance with an embodiment of the invention. The free weight ring 1 includes an enclosure 11 having an interior space and a fill within the interior space (see FIG. 5). The enclosure 11 is formed by a plurality of body sections 13, 15, and as shown, the enclosure 11 includes ten first body sections 13 and two second body sections 15. Each body section 13, 15 is formed from a flexible material as a section of a hollow cylinder, thereby forming the interior space. The body sections 13, 15 are coupled together in a manner described in greater detail below so that the enclosure 15 forms a shape approximating a torus, and in the embodiment shown, more specifically, an elliptical torus. In certain embodiments, the enclosure 15 may form a shape approximating a regular torus. As a balance between cost of manufacture and utility to the user, the approximated torus formed by the enclosure 15 in preferred embodiments may be formed by six, eight, or twelve sections. However, in certain other embodiments, more or fewer sections may be used to form the approximated torus. In each of these embodiments, when the free weight ring 1 is viewed in a planar view from above, such as is shown in FIG. 1, the shape of the free weight ring 1 will appear to be a polygon. In certain embodiments, this polygonal appearance may be of a regular polygon, or it may be of an irregular polygon. As should be appreciated, the approximation of a torus is improved with the greater number of body sections forming the free weight ring 1. In certain embodiments, the approximation of the torus may be a more irregular shape, in that there may be more than two types of body sections.

Suitable material for the body sections 13, 15 is a material that is non-porous to the fill to be included within the interior space formed by the enclosure 11 of the free weight ring 1. The material for the body sections 13, 15 is also preferably one that may be coupled by RF welding, ultrasonic welding, heat welding, stitching, and the like. The material is also preferably rugged and provides the free weight ring 1 with a textured exterior surface suitable for gripping. Although polyester, coated with vinyl chloride may be used, such material does not provide the abrasion resistance nor heat resistance of a preferred material, and under certain conditions it may also give off toxic vapor. Although a latex rubber or synthetic rubber may be used, it is not a preferred material due to the way it can age and crack, because some individuals are allergic to latex, and because under certain conditions synthetic rubber can give off a toxic vapor. A preferred material is nylon 6,6 with dual laminated polyurethane, as this material is non-porous to a preferred fill and may be heat or RF welded to effectively seal the fill within the interior space of the enclosure 11. In certain embodiments, other types of material may be used, not to be limited unless expressly stated in the claims.

In the embodiment shown, the difference between the first body sections 13 and the second body sections 15 are the lengths of the hollow cylinder section from which the body section pattern of each is formed. The resulting enclosure 11, which approximates an elliptical torus when the first and second body sections 13, 15 are fully assembled, includes an approximated minor diameter 17 of the approximated torus, which is the smallest perimeter circumscribing the inner circumference of the approximated torus, an approximated major diameter 19 of the approximated torus, which is the greatest perimeter circumscribing the outer circumference of the approximated torus, an approximated inner diameter 21, which is midway between the approximated minor diameter 17 and the approximated major diameter 19 of the approximated torus, and an approximated section diameter 23, which is the difference between the approximated major diameter 19 and the approximated minor 17 diameter along radial lines of the approximated torus. In certain embodiments, all body sections 13, 15 of the enclosure 11 may be formed with the same length so that the assembled body sections 13, 15 approximate a torus. In certain other embodiments, the length of the different body sections may vary as desired so that when the body sections are assembled, a more complex three-dimensional shape is formed. It should be recognized, however, that more complex three-dimensional shapes result in greater complexity during the manufacturing process, and some of the techniques described herein for coupling the sections together may not be suitable for all complex three-dimensional shapes.

Adjacent body sections 13, 15 are coupled together along inter-sectional seams 25, each inter-sectional seam 25 lying along an approximated section diameter 23. The axis of each section of hollow cylinder formed by each body section 13, 15 lies along the approximated inner diameter 21, and the axis of each section of hollow cylinder of one body section 13, 15 forms an obtuse angle with the axis of each section of hollow cylinder of adjacent body sections 13, 15.

As will be described below, during assembly of the free weight ring 1, a fill opening 27 is temporarily formed in the enclosure 11 so that a fill may be placed within the interior space of the enclosure 11. After the interior space of the enclosure 11 is filled, the fill opening 27 is sealed. Due to the manner in which the couplings between body sections 13, 15 and edges of body sections 13, 15 are made, none of the fill can easily escape. Therefore, it is expected that there is no need to add additional fill into the enclosure because some has escaped and needs to be replaced.

The fill is preferably a granular material (shown in FIG. 5) which is placed within the interior space of the enclosure 11 to add weight to the free weight ring 1. The granular fill may be selected to add the desired weight in combination with the volume to be filled within the interior space of the enclosure 11.

The granular fill may be composed of any type or mixture of granules, including, but not limited to, any one or more of plastic sand, silica sand, iron powder, iron sand, among other types of granules. To achieve a desired weight while also having the free weight ring 1 be as full as possible to prevent unwanted void spaces, a mixture of different types of granules may be used for the granular fill. In such mixtures, a first granular material may be mixed together with a second granular material, with the first granular material having a greater weight by volume as compared to the second granular material. For example, the granular fill may be composed of iron sand mixed with plastic sand, with the iron sand providing the bulk of the weight and the plastic sand serving as a light weight space filler in order to achieve the desired weight for the free weight ring 1. Free weight rings can generally be constructed to weigh insignificantly more than the weight of the material used to form the enclosure 11, using a foam pellet fill, all the way up to 50 lbs or more. As will be appreciated, the higher weights may be achieved using a heavier granular fill combined with a larger volume of enclosure.

Figure 2A:
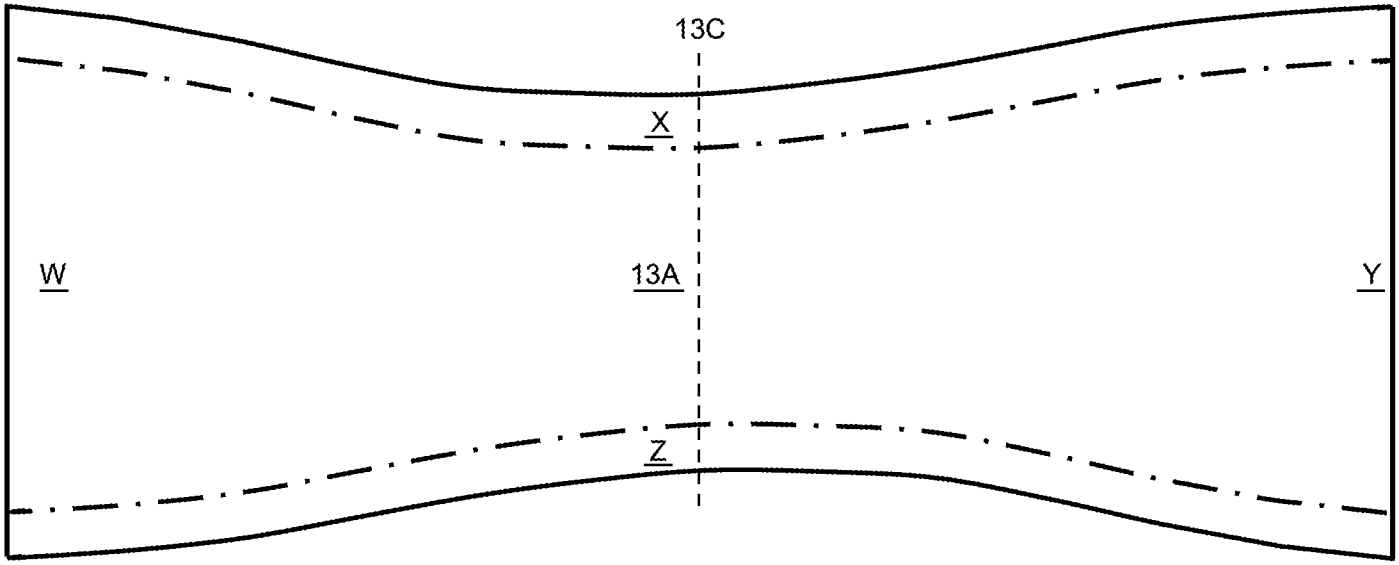
FIGS. 2A-B show pattern views of first and second sides of a first section of the free weight ring of FIG. 1.
Figure 2B:
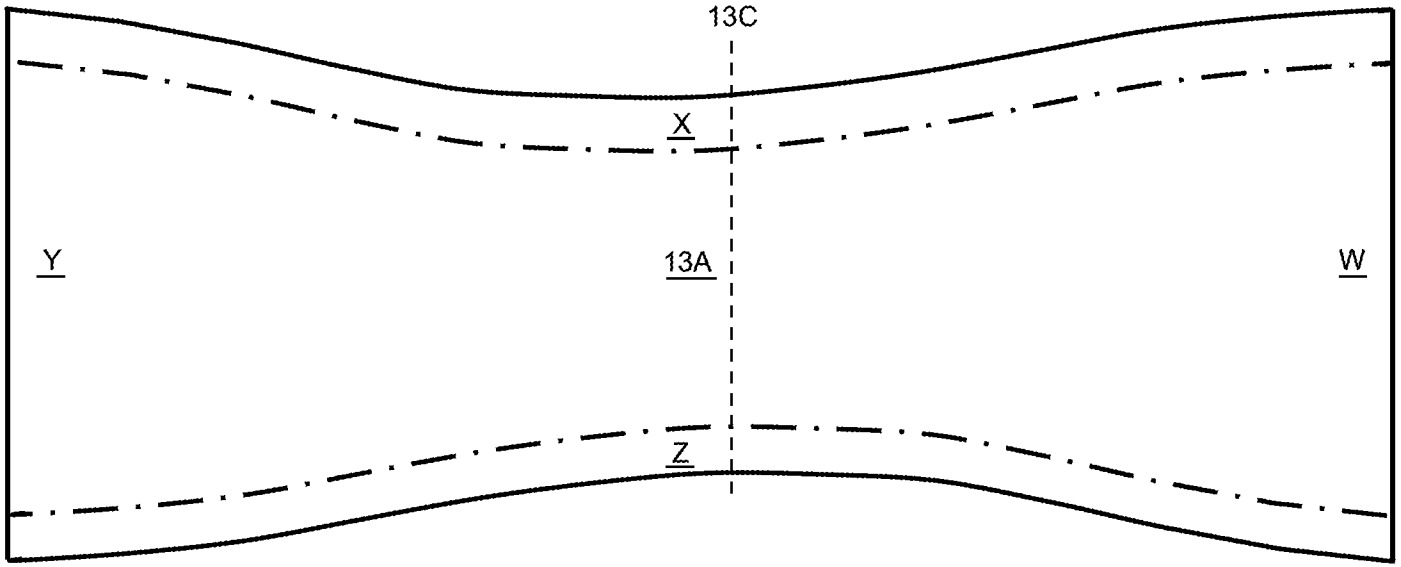

FIGS. 2A-B show a first body section pattern for the first body sections 13 of the enclosure 11. The external side 13A of the first body section pattern (the side that will be external for the enclosure 11) is shown in FIG. 2A, and the internal side 13B of the first body section pattern (the side that will be internal for the enclosure 11) is shown in FIG. 2B. The first body section pattern has an hourglass shape, and the narrowest part, along line 13C, is the part of the first body section pattern that will lie along the approximated inner diameter 17 of the enclosure 11. The first body section pattern is based on a cylinder that has been cut at approximately a 15° angle to the major axis of the cylinder on both ends thereof. Thus, if a square (or rectangular) piece of material to be formed into the first section is rolled into a cylinder, with the material in a single layer forming the circumference of the cylinder, and the material is then cut at an angle on both sides, when the material is unrolled it would appear as shown in FIGS. 2A-B. In certain embodiments, the cut angle may be different than 15°. It should be apparent that the cut angle used for each section has an impact on the shape of the enclosure and how may sections, and the sizes of each section, are needed to form a fully formed enclosure 11 for the free weight ring 1. In still other embodiments, the effective cut angle for each side of the of the material may be a different angle. As should also be apparent different cut angles may add to the overall complexity of the design and manufacture of the free weight ring 1 without departing from the inventive concepts disclosed herein.

It should also be apparent that the dimension of the patterns between the W and Y edges impacts the volume of the enclosure, with smaller dimensions between the W and Y edges resulting in a smaller volume of enclosure. The weight of the finished free weight ring 1 may therefore be dependent not only upon the type of fill, but also upon the volume of the enclosure 11.

The dotted lines shown in FIG. 2A show the outline of the surface that will be visible once the sections are coupled together and the enclosure 11 for the free weight ring 1 is formed. In FIGS. 2A-B, the body section pattern includes a first short (straight) edge W, a first long (curved) edge X, a second short (straight) edge Y, and a second long (curved) edge Z. The first and second long edges X, Z are used to couple one body section to adjacent body sections, and the first and second short edges W, Y are coupled together to form a section seam that aligns with the major diameter 19 of the approximated torus. As will be appreciated, by forming the body section patterns in this manner, from a unitary piece of material with only a single seam as indicated, there is no seam in the finished free weight ring 1 lying along the minor diameter of the approximated torus.

Figure 3A:
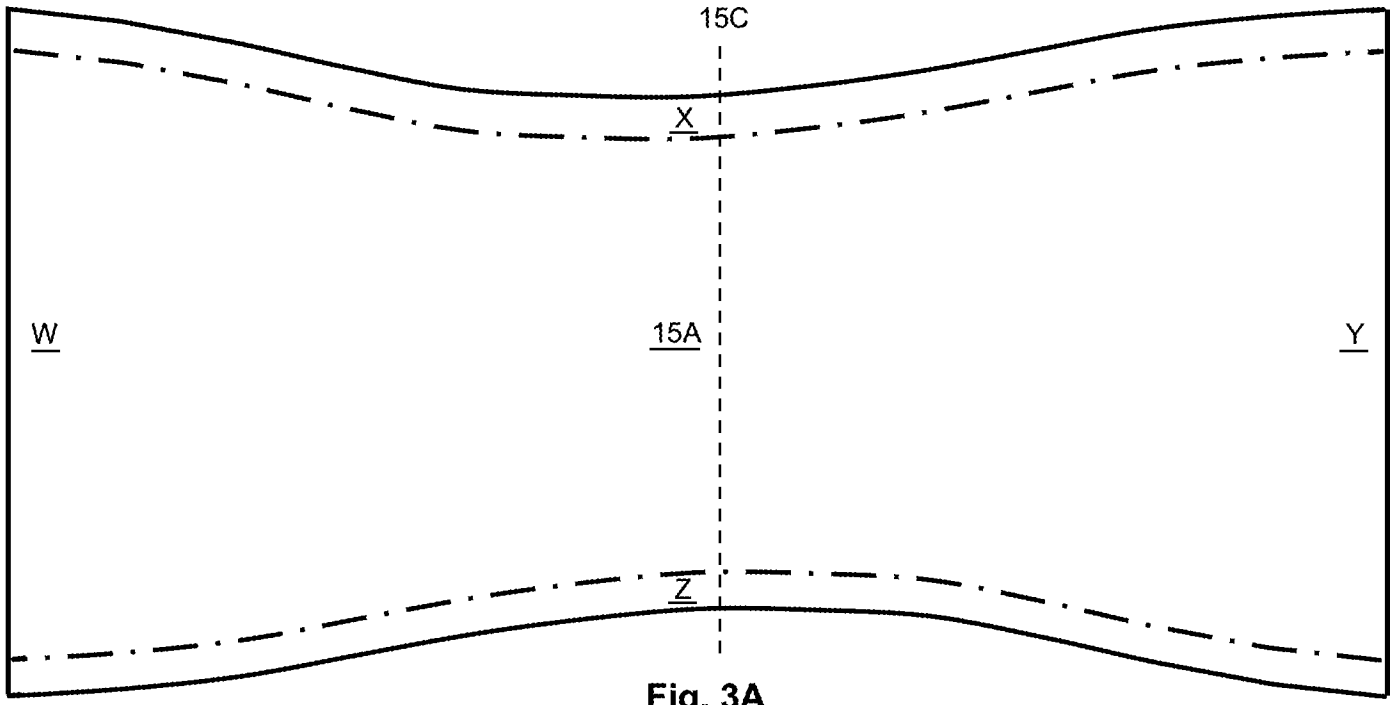
FIGS. 3A-B show pattern views of first and second sides of a second section of the free weight ring of FIG. 1.
Figure 3B:
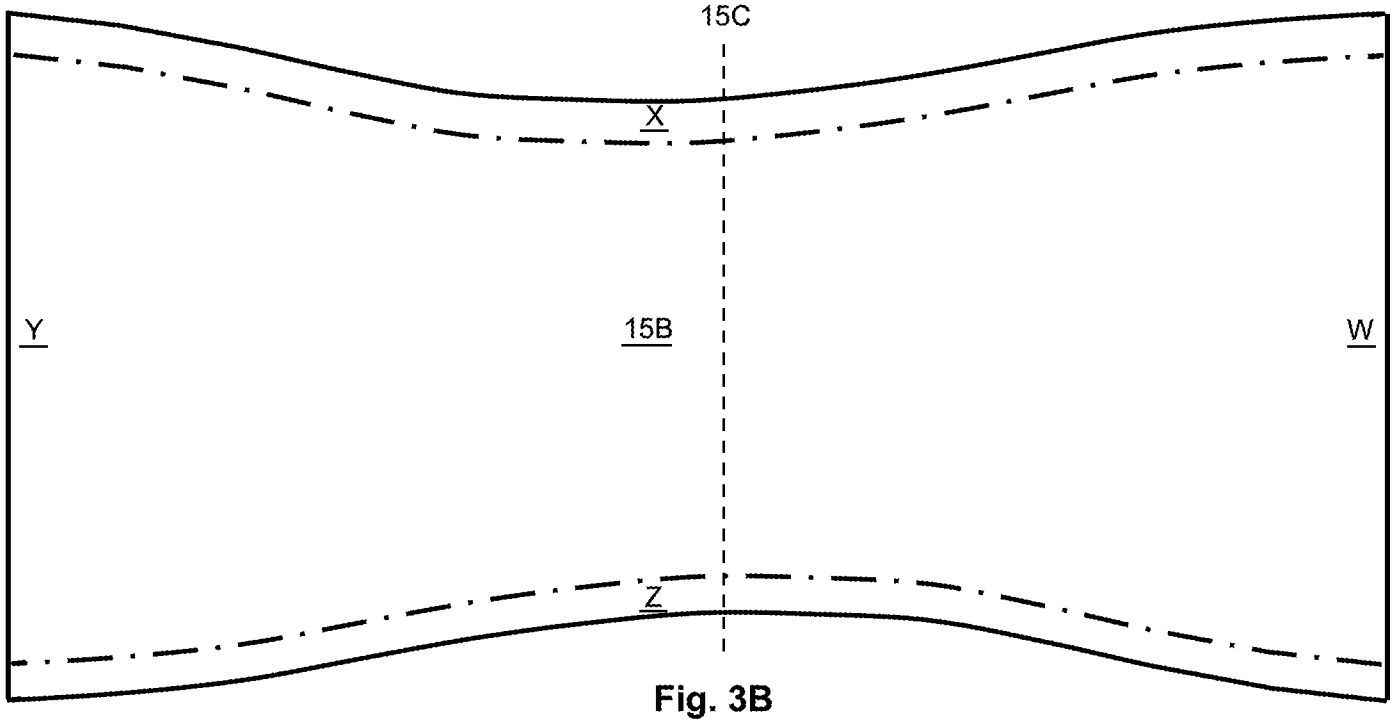

FIGS. 3A-B show a second body section pattern for the second body sections 15 of the enclosure 11. The external side 15A of the second body section pattern (the side that will be external for the enclosure 11) is shown in FIG. 3A, and the internal side 15B of the second body section pattern (the side that will be internal for the enclosure 11) is shown in FIG. 3B. The second pattern also has an hourglass shape, and the narrowest part, along line 15C, is the part of the first body section pattern that will lie along the approximated inner diameter 17 of the enclosure 11. The second body section pattern is also based on a cylinder that has been cut at approximately a 15° angle to the major axis of the cylinder on both ends thereof in a manner similar to that described above for the first pattern. The dotted lines shown in FIG. 3A show the outline of the surface that will be visible once the sections are coupled together and the enclosure 11 for the free weight ring 1 is formed. In FIGS. 3A-B, the pattern includes a first short (straight) edge W, a first long (curved) edge X, a second short (straight) edge Y, and a second long (curved) edge Z. The first and second long edges X, Z are used to couple one body section to adjacent body sections, and the first and second short edges W, Y are coupled together to form a section seam that aligns with the major diameter 19 of the approximated torus.

Figure 4A:
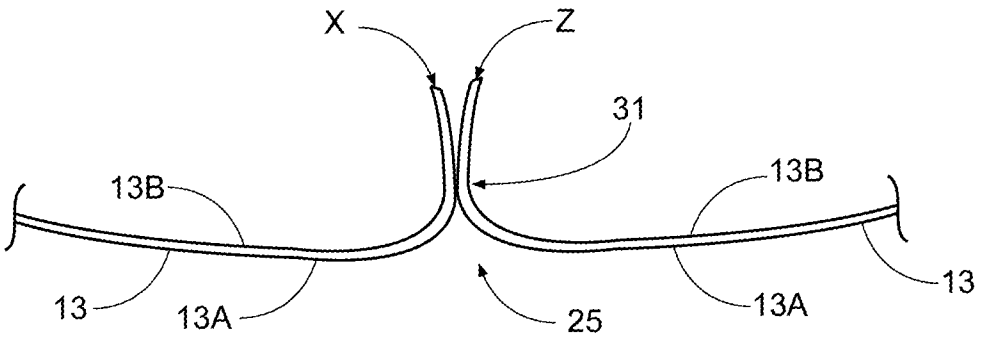
FIGS. 4A-B illustrate a coupling between adjacent sections of the free weight ring.
Figure 4B:
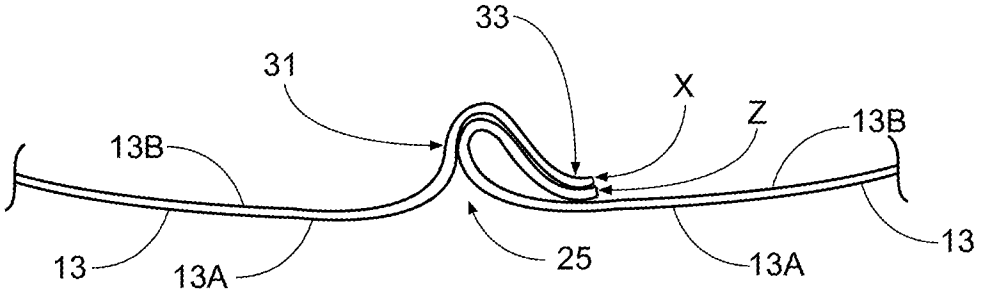

To form the enclosure 11, the X edge of each body section pattern is coupled to the edge of an adjacent body section pattern. In order to accomplish this, two pieces of material, each based on one of the body section patterns shown in 2A-B and 3A-B, are aligned with the external A sides facing each other, such that the X edge of each is aligned with the Z edge of the other. Then, only one of the two aligned X-Z edges are coupled to form an inter-sectional seam 25 as shown in FIG. 4A. The other aligned X-Z edges are left free for coupling to other sections. As shown in FIG. 4A, two first body section patterns are initially coupled together along the entirety of one of the aligned X-Z edges at a coupling junction 31 to form the inter-sectional seam 25. As indicated above, depending upon the material used, the coupling junction 31, and any other coupling used to form the enclosure, may be formed through the use of radio frequency (RF) welding, ultrasonic welding, heat welding, stitching, and the like. When the material used is nylon 6,6 with dual laminated polyurethane, heat or ultrasonic welding may be used. After the first coupling junction 31 is formed, the coupled X and Z edges form an edge extension, and instead of allowing this edge extension to remain freely extending into the interior of the enclosure 11, it is flattened against one of the internal B sides in a secondary coupling junction 33 as shown in FIG. 4B. In this embodiment, the flattened edge extension is coupled to the internal B side of one of the body section patterns. The flattening of the edge extension serves to minimize void spaces within the enclosure 11 and to reduce and or eliminate pathways for the granular fill to escape from the interior of the enclosure 11.

For the enclosure 11 shown in FIG. 1, ten pieces of material cut according to the first section pattern of FIGS. 2A-B and two pieces of material cut according to the second section pattern of FIGS. 3A-B are coupled side-by side in the order shown in FIG. 1 using the coupling technique described in association with and shown in FIGS. 4A-B. The result is a sort of corset which already has the minor diameter 17 of the approximated elliptical torus formed, and with the major diameter 19 yet to be formed.

Figure 5:
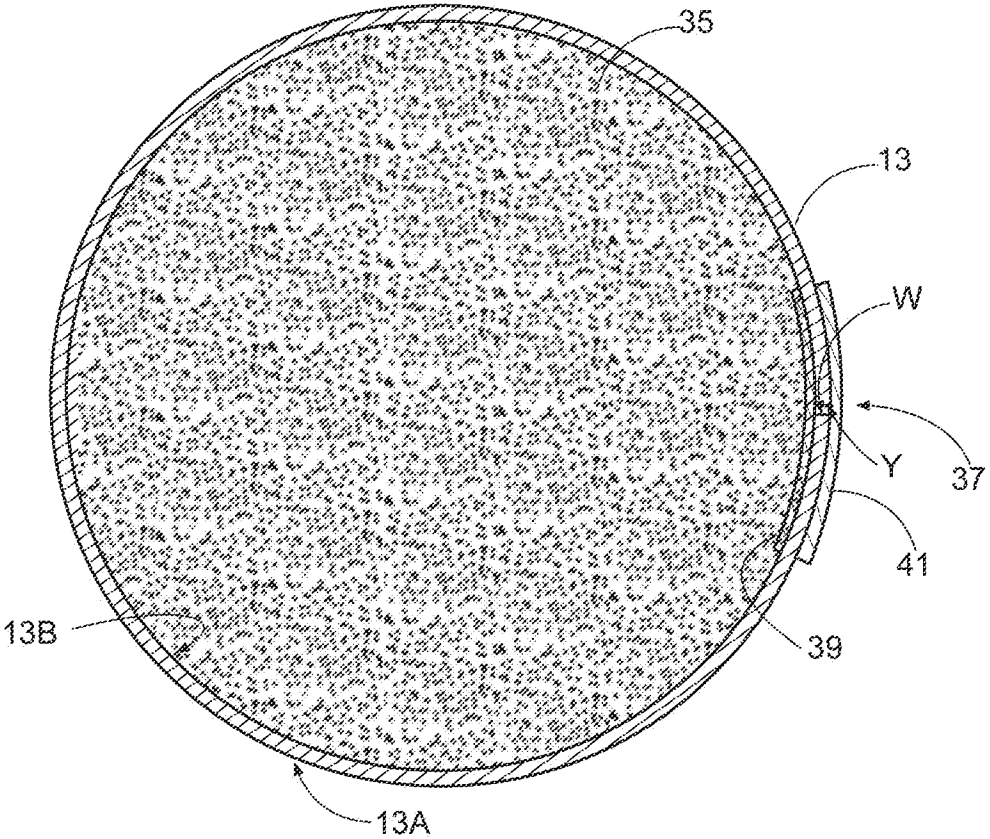
FIG. 5 shows a cross-sectional view of the free weight ring of FIG. 1 along the line V-V.
Figure 6A:
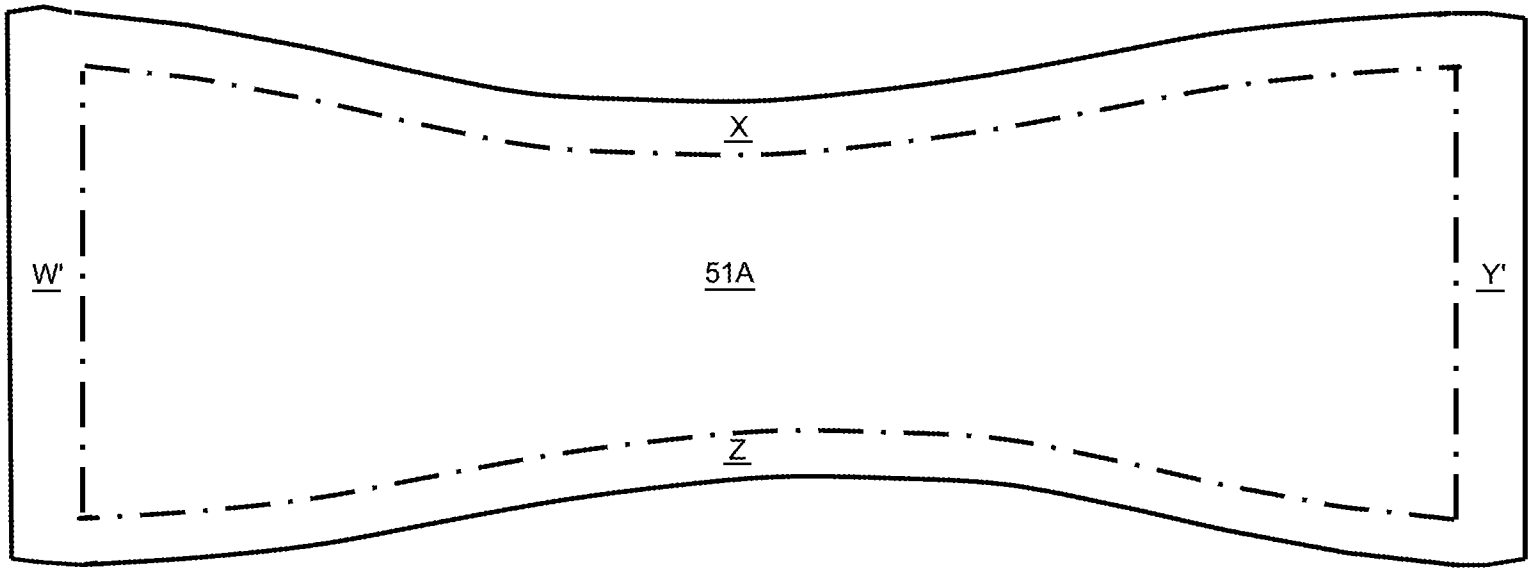
FIGS. 6A-B show pattern views of first and second sides of a first section of a free weight ring in accordance with a second embodiment.
Figure 6B:
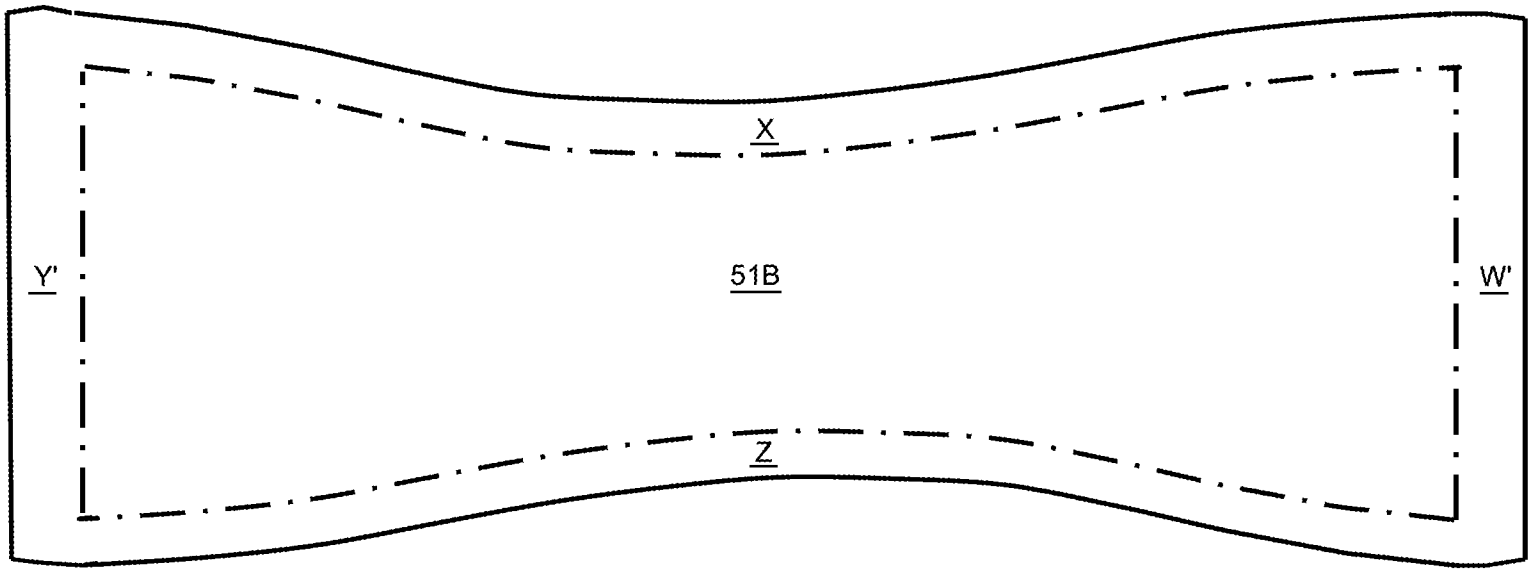
Figure 7A:
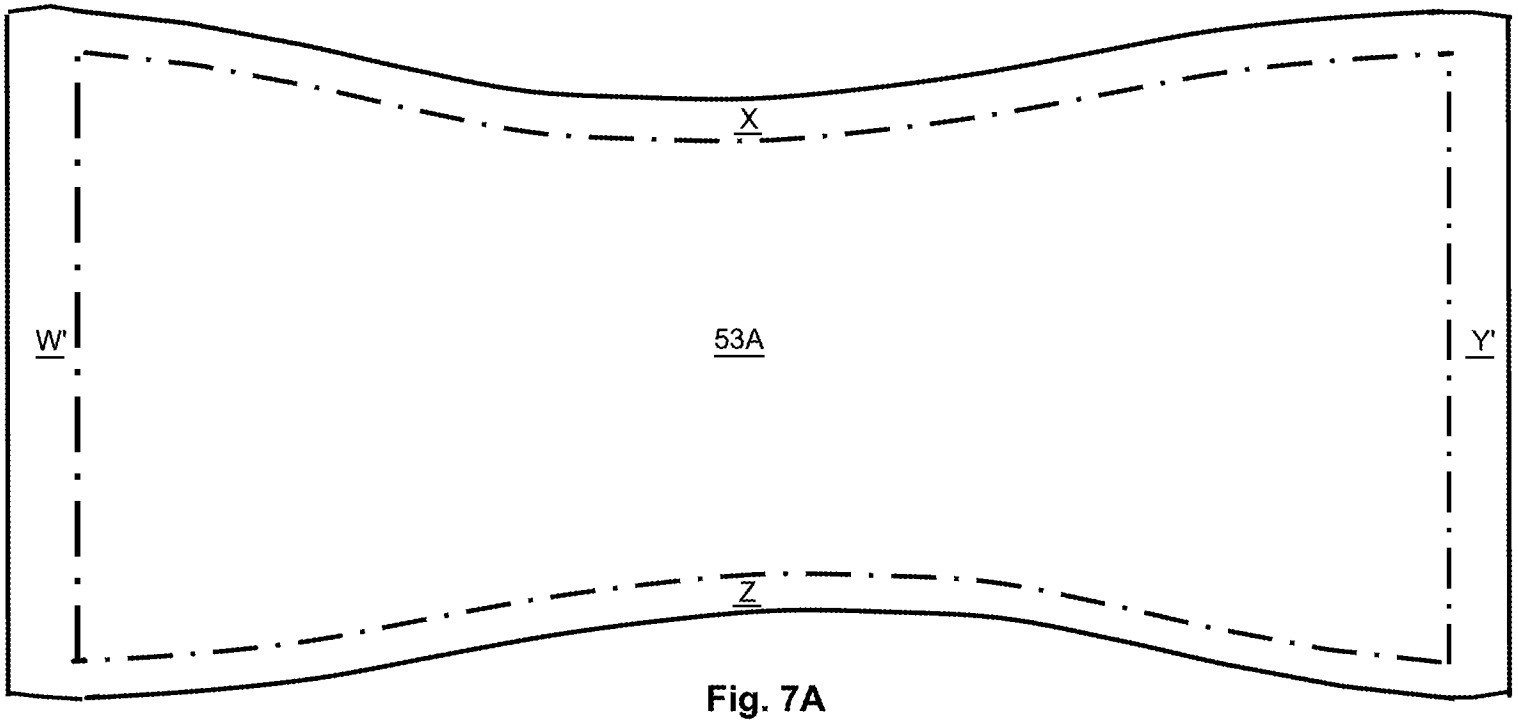
FIGS. 7A-B show pattern views of first and second sides of a second section of a free weight ring in accordance with the second embodiment.
Figure 7B:
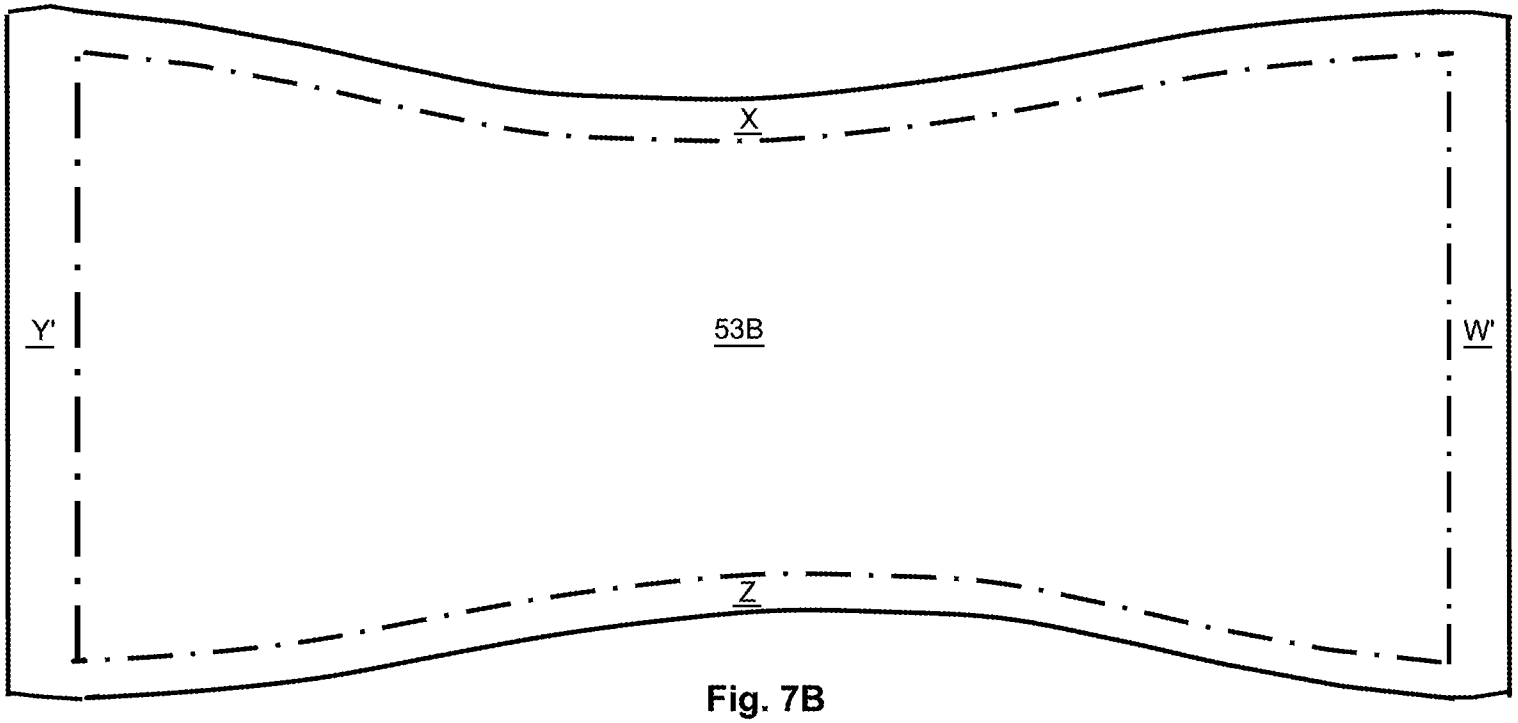

FIG. 5 illustrates the coupling between the W and Y edges of each body section pattern in order to form a sectional seam 37 and finish forming each of the body sections 13, 15. These W and Y edges are initially coupled for all but one or two of the body section patterns, such that a fill opening (27 in FIG. 1) for inserting the fill remains open along the major diameter 19. Once a fill is inserted into the enclosure, the fill opening 27 may be closed by coupling the sides of the fill opening 27 together so that the enclosure 11 is fully sealed with the fill inside. FIG. 5 shows a cross section of the finished free weight ring 1 with the granular fill 35 within the enclosure 11. As shown, the sectional seam 37 is formed by the W and Y edges being positioned to abut one another, with the abutting edges being covered by a first sectional seam cover 39 and a second sectional seam cover 41. The first sectional seam cover 39, made from the same material used for the first and second body sections 13, 15, is positioned on the interior of the enclosure 11 and may have the same length as the W and Y edges of each body section pattern. In alternative embodiments, the first sectional seam cover 39 may have a length that extends across the W and Y edges of more than one adjacent body section pattern. A first sectional seam cover 39 is coupled to the all of the W and Y edges, except for one or two of the body section patterns to leave the fill opening 27, along the interior of the enclosure 11. After the granular fill is placed within the enclosure, the first sectional seam cover 39 may be coupled to the W and Y edges of the body section patterns that form the fill opening 16. This process seals the granular material within the enclosure. Finally, the second sectional seam cover 41, which is again made from the same material used for the first and second body sections 13, 15 and is approximately the same length as the approximated major diameter 19 of the enclosure 11, is coupled to all of the W and Y edges along the exterior of the enclosure 11 fully around the approximated major diameter 19 of the enclosure 11. This second sectional seam cover 41 helps provide and additional seal along the approximated major diameter 19 of the enclosure 11 where the W and Y edges of the first and second body section patterns abut. This additional seal serves to reduce and or eliminate pathways for the granular fill to escape from the interior of the enclosure 11. In certain embodiments, only one of the first sectional seam cover 39 and second sectional seam cover 41 are included as part of the sectional seams 37.

The free weight ring 1 just described has comfort advantages to the way in which it is formed as compared to free weights known in the prior art. One advantage is that the material used is comfortable and easy to grip. Also, the manner in which the free weight ring 1 is formed leaves no seam around the approximated minor diameter 17 of the enclosure 11 of the free weight ring 1, and the lack of a seam leaves the approximated minor diameter 17 of the enclosure 11 of the free weight ring 1 very comfortable to grip. In addition, the sectional seams 37 around the approximated major diameter 19 or the free weight ring 1 is flat without protruding material, thus also making the approximated major diameter 19 or the free weight ring 1 as equally comfortable to grip as the approximated minor diameter 17 or the free weight ring 1. The free weight ring 1, in its preferred embodiment, is also highly symmetrical, such that no matter how a user picks up the free weight ring 1, it is comfortable to grip.

Figure 8:
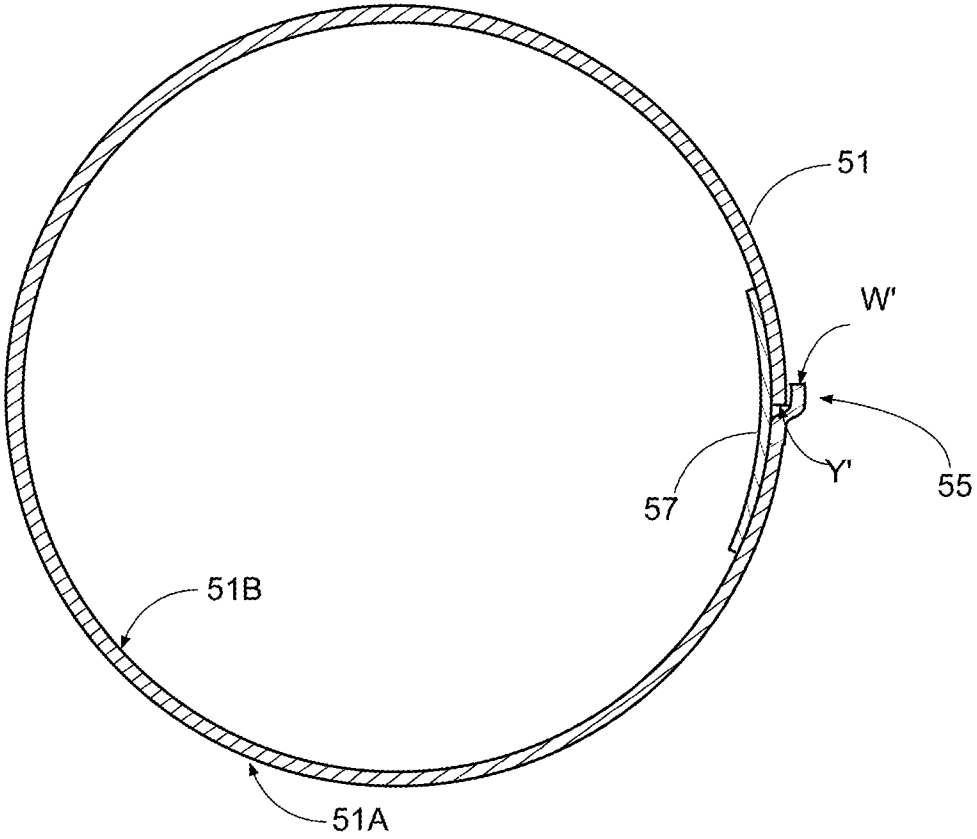
FIG. 8 illustrates a first coupling configuration between edges of a section of a free weight ring.

Alternative body section patterns for the first and second body sections 51, 53 of a free weight ring are shown respectively in FIGS. 6A-B and 7A-B. In these body section pattern embodiments, additional material is provided at the W' and Y' ends of the respective patterns 51A, 53B as compared to the patterns shown in FIGS. 2A-B and 3A-B. As shown in FIG. 8, the additional material at the W' and Y' edges may be used to form the sectional seam 55 as an overlap junction at the outer perimeter of the free weight ring, with the W' and Y' edges coupled together at the overlap junction by an appropriate coupling technique, such as heat or ultrasonic welding. In this configuration, a material strip 57 is coupled to both the W' and Y' edges on the interior of the enclosure to provide an additional sealing along the approximated major diameter of the enclosure.

Figure 9:
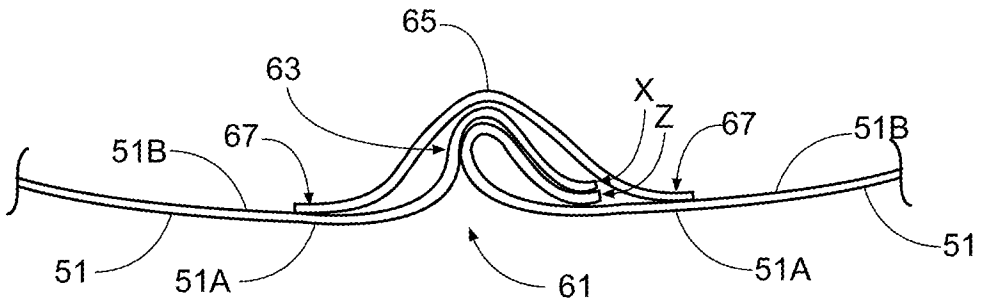
FIG. 9 illustrates a coupling between adjacent sections of the free weight ring in accordance with the second embodiment.

An alternative method for coupling adjacent sections together at the inter-sectional seam 61 is shown in FIG. 9. In this alternative method, the X and Z edges of the body section patterns are coupled together at a coupling junction 63 in the same manner as shown in FIG. 4A. However, instead of the edge extensions being folded over and coupled to the internal sides 31B of the body section pattern material, they are folded over and a coupling junction cover 65 is placed over edge extensions. This coupling junction cover 65 is then coupled to the internal sides 31B of the pattern material at secondary coupling junctions 67 by an appropriate coupling technique, such as heat or ultrasonic welding. By placing the coupling junction cover 65 over coupling junction 63 and the edge extensions in this manner, the coupling junction 63 and the edge extensions are isolated from the interior space formed by the enclosure. This isolation serves to better ensure that any granular fill does not escape from the interior space of the enclosure.

Figure 10:
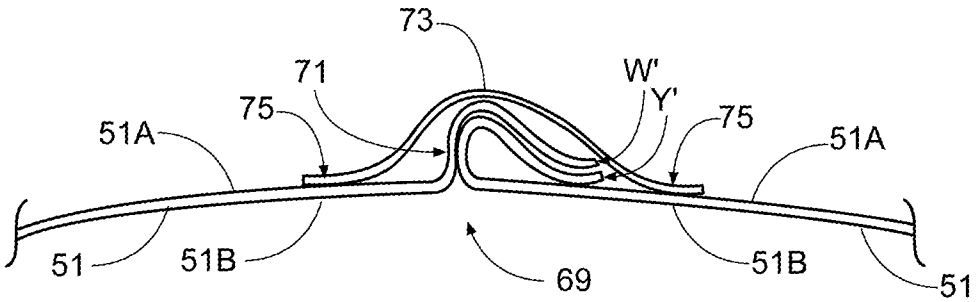
FIG. 10 illustrates a second coupling configuration between edges of a section of a free weight ring.

A similar alternative method for coupling the W' edge to the Y' edge at the section seam 69 along the outer perimeter of the enclosure may be used, as is shown in FIG. 10. In this alternative method, the W' and Y' edges of the body section patterns are coupled together at a coupling junction 71 in a similar manner shown for the X and Z edges in FIG. 4A, with the W' and Y' edges on the outside of the enclosure to form edge extensions extending away from the interior of the enclosure. The edge extensions are folded over and coupling junction cover 73 is placed over coupling junction 71 and the edge extensions. This coupling junction cover 73 is then coupled to the external A sides of the body section pattern material in secondary coupling junctions 75 by an appropriate coupling technique, such as heat or ultrasonic welding.

It should be recognized that any of the coupling techniques disclosed herein can be used for any of the coupling junctions and/or seams that are formed in the process of constructing a free weight ring.

Figure 11:
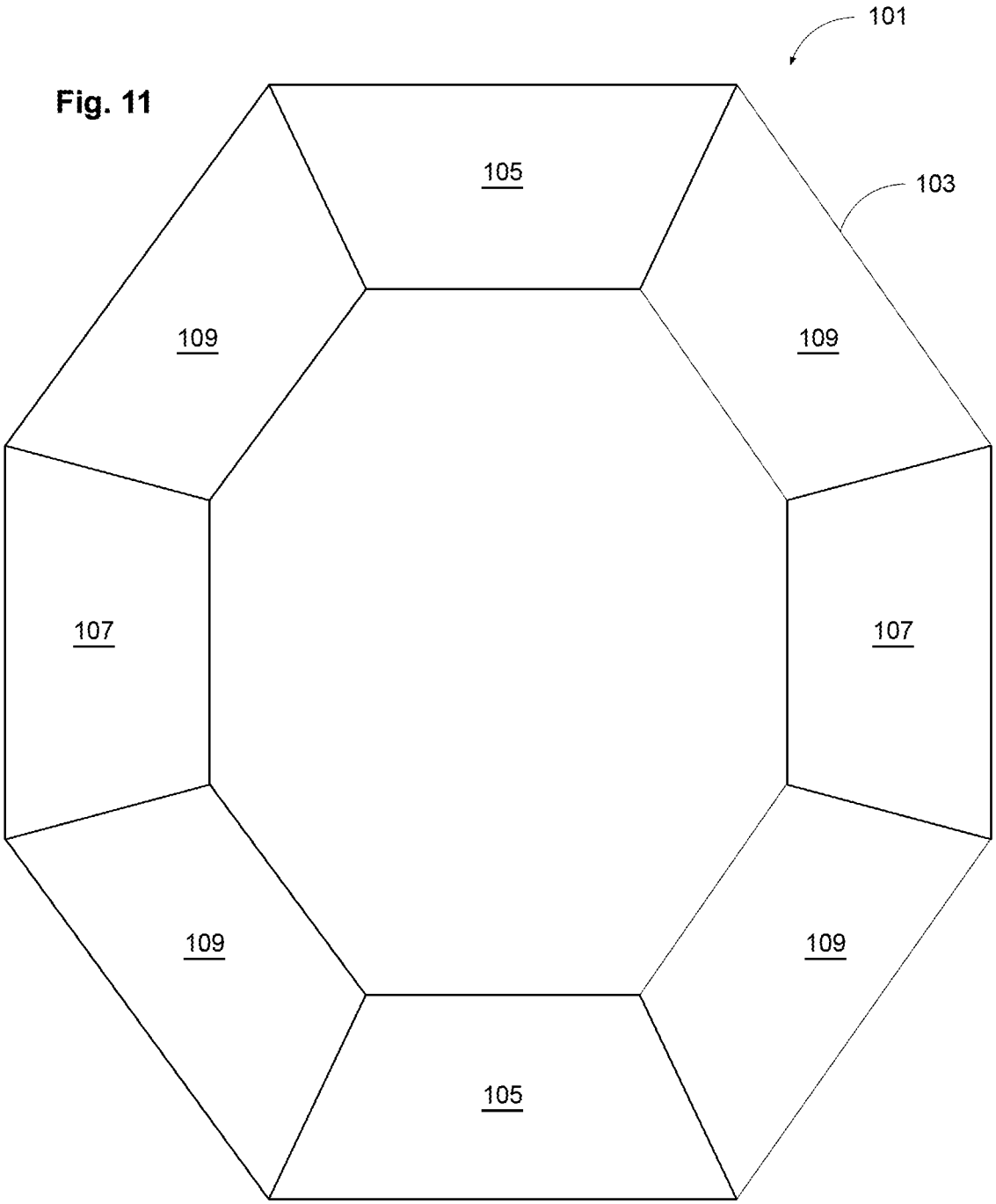
FIG. 11 shows top planar view of a free weight ring in accordance with a second embodiment.

An alternative embodiment of a free weight ring 101 is shown in FIG. 11. In this embodiment, the enclosure 103 is formed by a total of eight body sections, 105, 107, 109, including two first body sections 105, two second body sections 107, and four third body sections 109. Each of these different body sections 105, 107, 109 is formed from a different body section pattern, each being similar to those shown in FIGS. 2A-B, 3A-B, 6A-B, and 7A-B. However, each of the body section patterns used to form the different body sections 105, 107, 109 may have different dimensions than those described above. In addition, any of the coupling techniques disclosed herein can be used as part of forming the different body sections 105, 107, 109. The construction of the free weight ring 101 is therefore substantially similar to that of the free weight ring 1 shown in FIG. 1, with the exception that different dimensions of body section patterns are used to construct the enclosure, and the a different number of body section patterns are used to construct enclosure, thereby resulting in a different overall shape of the free weight ring 101.

The free weight ring disclosed herein is versatile, waterproof, non-toxic, and can be taken anywhere. It also provides significant safety from accidental drops, as the granular fill absorbs some of the force from an impact and there are no hard edges that can be the cause of significant bruising and crushing injuries upon impact.

The free weight ring is versatile in that a user can take it on a run, take it hiking, swim with it, use it on a couch or chair, and toss lighter weight versions to a friend.

The free weight ring is also versatile in that it may be used with a variety of strengthening exercises, including: squat, squat and swing, clean and press, thrusters, deadlift, lunges, leg extension, leg curl, leg adduction, leg abduction, foot slides, ab crunch, sit on (ab crunch, scissor), oblique twist, planks, side planks, shoulder press, overhead front press, pullover, chest press, chest fly, overhead lateral fly, undercut front fly, bent over swimmer fly, bent over reverse fly (rear delt/rhomboid), lateral raise, anterior raise, shoulder circles, should shrugs (trapezius), bent over rhomboid shrugs, supermans, bent over rows, bent over swimmer extension, bent over shoulder overhead extension, triceps kick back, overhead triceps extension, bicep curl, reverse curl, forearm curl, forearm extension, forearm internal/external rotation. The free weight ring may also be safely and easily gripped with a single hand, or both hands may be used to grip it, and the multiple ways of gripping the free weight ring makes it possible to use a free weight ring with a large variety of exercises.

In addition, a strap may be paired with and coupled to a free weight ring to increase versatility, such as for: strapping around the ankle or lower leg; coupling multiple free weight rings together to increase weight; providing extra resistance during certain exercises, such as leg extension, leg curl, leg abduction, leg adduction, dips, or pull-ups; resting on the user's lap for bench dips; resting on the user's back for pushups; strapping to the back for hiking and running; strapping to the user's forearm for cardio exercises such as shadow boxing; and using freely for cardiovascular exercises such as box jumps, tossing, slamming, toss-n-squat.

The free weight ring may also help increase flexibility and balance during stretching routines and positional exercises, such as all full body extension, standing, and supine stretches, calf stretches, quadriceps stretches, and entire exercise routines such as yoga, and Pilates. Versatility is also provided by being able to change resistance by changing the grip and lever angle. This can be done by gripping a side of the free weight ring so that the other side extends away from the hand (or other body part), or by gripping the free weight ring so that the side that is not gripped is closer to the body than the side that is gripped. Increased range of motion is offered due to the oblong shape of the free weight ring and the user's ability to hold it in different directions, so that the user doesn't hit their knees, forearms, head, or the floor. In addition, by holding the free weight ring on one end, the user can add a degree of difficulty to work smaller intrinsic muscles to help stabilize upper extremity joints.

For rehabilitation, the free weight ring provides a full range of motion with all the above advantages, with the additional advantages of sliding on stretch table, internal/external rotation (standing, bent over, lying supine, side lying, prone on table, against wall), wall angels, foot pressure points, and iliotibial band pressure points.

The free weight ring is also suitable for use by individuals with varying medical conditions, including: wounded warriors/prosthetics, as it is able to be held with minimal friction/grip; child development; Muscular Dystrophy; Turner Syndrome; Down Syndrome; Lou Gehrig's; post-stroke; and Alzheimer's. Importantly for many of these types of users, the free weight ring is safe and comfortable in the user's lap (i.e., it is not intimidating).

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A free weight comprising:

an enclosure comprising a plurality of body sections assembled in a shape approximating a torus, each body section forming part of the approximated torus and having a sectional seam formed along an approximated major diameter of the approximated torus, and each body section is coupled to each adjacent body section at an inter-sectional seam, each inter-sectional seam formed along an approximated section diameter of the approximated torus; wherein each inter-sectional seam comprises a coupling junction formed by edge portions of adjacent body sections coupled together, each coupling junction extending toward an interior of the approximated torus;

a fill disposed within an interior space formed by the enclosure; and a plurality of coupling junction covers, each coupling junction cover placed over one of the coupling junctions and coupled to an inner wall of the enclosure so as to isolate each coupling junction from the interior space.

2. The free weight of claim 1, wherein each body section includes a first short edge and a second short edge, the first short edge being coupled to the second short edge at the sectional seam.

3. The free weight of claim 2, each sectional seam comprising at least one sectional seam cover, the at least one sectional seam cover coupled to each of the first short edge and the second short edge of each body section at one of an inner surface or an outer surface of the enclosure.

4. The free weight of claim 1, wherein the fill comprises a granular fill.

5. The free weight of claim 4, wherein each body section is formed from a material which is non-porous to the granular fill.

6. The free weight of claim 4, wherein the granular fill comprises a first granular material and a second granular material, the first granular material having a greater weight by volume than the second granular material.

7. The free weight of claim 1, wherein each body section is formed from a unitary piece of material.

8. The free weight of claim 1, wherein each body section is formed with a single seam, the single seam comprising the sectional seam.

9. The free weight of claim 1, wherein each body section is formed as a hollow cylinder section.

10. The free weight of claim 1, wherein each coupling junction is coupled to the inner wall of the enclosure.

11. A method of making a free weight, the method comprising:

coupling a plurality of body section patterns together, each body section pattern comprising a first long edge, a second long edge, a first short edge, and a second short edge, the first long edge of each body section pattern coupled to the second long edge of another body section pattern;

coupling the first short edge to the second short edge of each body section pattern so that each body section pattern forms a hollow cylinder section, the combined hollow cylinder sections forming an enclosure in a shape approximating a torus, the short edges of the body section patterns forming a sectional seam along an approximated major diameter of the approximated torus, wherein a gap is left in the short edges of at least one of the body section patterns for insertion of a fill into an interior space formed by the enclosure;

filling the interior space with the fill; and sealing the gap.

12. The method of claim 11, wherein coupling the first long edge of each first body section pattern to the second long edge of another body section pattern comprises forming a coupling junction from edge portions of the coupled body section patterns.

13. The method of claim 12, further comprising coupling each coupling junction to an inner wall of the enclosure.

14. The method of claim 12, further comprising placing a coupling junction cover over each coupling junction, the coupling junction cover being coupled to an inner wall of the enclosure so as to isolate each coupling junction from the interior space of the enclosure.

15. The method of claim 11, wherein the fill comprises a granular fill.

16. The method of claim 15, wherein the granular fill comprises a first granular material and a second granular material, the first granular material having a greater weight by volume than the second granular material.

17. The method of claim 11, wherein coupling the first short edge to the second short edge of each body section pattern comprises coupling a sectional seam cover to each of the first short edge and the second short edge of each body section pattern at one of an inner or an outer surface of the enclosure.

18. The method of claim 15, wherein each body section pattern is formed from a material which is non-porous to the granular fill.

19. A free weight comprising: an enclosure comprising a plurality of body sections assembled in a shape approximating a torus, each body section forming part of the approximated torus and having a sectional seam formed along an approximated major diameter of the approximated torus, and each body section is coupled to each adjacent body section at an inter-sectional seam, each inter-sectional seam formed along an approximated section diameter of the approximated torus; wherein each of the body sections comprise a minor diameter circumscribing an inner circumference of the torus and a major diameter circumscribing an outer circumference of the torus, the major diameter being greater than the minor diameter; wherein each of the body sections has an hourglass shape in which a narrowest part lies substantially along an inner diameter of the enclosure; and a fill disposed within an interior space formed by the enclosure.

* * * * *